US011950716B2

(12) United States Patent
Witkowski

(10) Patent No.: US 11,950,716 B2
(45) Date of Patent: Apr. 9, 2024

(54) FOOD HOLDER

(71) Applicant: Mary Witkowski, Sunnyvale, CA (US)

(72) Inventor: Mary Witkowski, Sunnyvale, CA (US)

( * ) Notice: Subject to any disclaimer, the term of this patent is extended or adjusted under 35 U.S.C. 154(b) by 541 days.

(21) Appl. No.: 17/347,783

(22) Filed: Jun. 15, 2021

(65) Prior Publication Data

US 2022/0395120 A1 Dec. 15, 2022

(51) Int. Cl.
*A47G 21/00* (2006.01)

(52) U.S. Cl.
CPC ..... *A47G 21/001* (2013.01)

(58) Field of Classification Search
CPC ..... A47G 21/001; A47J 43/28; A47J 43/283; A47J 45/10; A45F 2005/1006
USPC ..... 294/5, 25, 33, 145, 148; 16/422, 431
See application file for complete search history.

(56) References Cited

U.S. PATENT DOCUMENTS 1,261,706 A * 4/1918 Condley et al. ..... A61F 13/105 2/21
3,934,915 A 1/1976 Humpa
4,197,611 A * 4/1980 Bell ..... A47J 45/08 220/753
4,577,900 A 3/1986 Chasen
4,728,139 A 3/1988 Oretti
4,802,704 A 2/1989 Burns
4,877,280 A 10/1989 Milano
4,976,299 A * 12/1990 Bickelman ..... A61B 46/10 362/804
5,465,461 A * 11/1995 Sandel ..... B25G 1/02 16/421
5,709,423 A * 1/1998 Romero ..... A47G 21/10 294/99.2
6,131,244 A * 10/2000 Bares ..... B25G 1/12 30/341
7,165,270 B2 1/2007 DeYoung
8,943,612 B2 * 2/2015 Jeong ..... A41D 19/0055 2/21
9,661,871 B2 5/2017 Gagliardi
10,441,114 B2 10/2019 Rampersad
2006/0237470 A1 * 10/2006 Zanner ..... A47J 45/085 220/752
2010/0330328 A1 * 12/2010 Lee ..... B32B 29/02 428/99

(Continued)

OTHER PUBLICATIONS

Unique Bargains Heat Resistant Silicone Pot Pan Handle Grip Holder Sleeve Cover Blue 2pcs, https://www.kmart.com/unique-bargains-heat-resistant-silicone-pot-pan-handle, May 31, 2020.

(Continued)

*Primary Examiner* — Dean J Kramer
(74) *Attorney, Agent, or Firm* — Guy Cumberbatch

(57) ABSTRACT

An eating utensil for gripping food such as chicken drumsticks is disclosed. The utensil has a tube which is shaped and dimensioned to accommodate the end of the chicken drumstick. The utensil is made of a springy material such as silicone so that finger pressure may bend the material to grip the chicken. The opening is sized to accommodate the shape of the food and provide more secure gripping thereof. A material such as a soft non-slip grip silicone may be used. A plastic ridge surrounds the top to act as a plastic "grease dam" and keep drips from the hand. A small hole at the bottom allows for easy cleaning and drying.

17 Claims, 3 Drawing Sheets

(56) References Cited

U.S. PATENT DOCUMENTS

2018/0070752 A1* 3/2018 Feicht ..... A47G 21/001

OTHER PUBLICATIONS

Zyliss® Garlic Peeler _ Bed Bath & Beyond; https://www.bedbathandbeyond.com/store/product/zyliss-reg-garlic-peeler; May 31, 2020.
China Custom Food Grade Rubber/Silicon Case/Sleeve Silicone Adapter; https://bettersilicone.en.made-in-china.com/product; May 31, 2020.
Drumstick-shaped spice mesh; https://es.aliexpress.com/i/32955119888.html 1/; May 31, 2020.
Holders for Chops and Chicken Legs; https://www.toyboxtech.com/regency-chop-frills-decorative-holders-for-chops-and-chicken-legs-4-chicken-frills-and-8-chops-frills/; May 31, 2020.

* cited by examiner

FOOD HOLDER

RELATED APPLICATION INFORMATION

This is an original application.

BACKGROUND

Field

This disclosure relates to utensils used for eating food and, more particularly, to such utensils for gripping and holding food such as chicken drumsticks to facilitate eating thereof.

Description of the Related Art

Chicken legs or drumsticks, after cooking, are typically eaten either solely by hand, that is, by the user grasping the end of the chicken leg, or more typically, by the aid and use of chicken drumstick holders which are inserted into the one tip end and the other butt end of the chicken drumstick in a secured fashion which enables the user to grasp such holders while eating the meat off the chicken drumstick.

There have been numerous chicken leg holders suggested. In particular, those chicken drumstick holders presented commercially available include those which use jaw mechanisms.

Many types of foods are commonly eaten by gripping and holding the food between the fingers and thumb due to the awkwardness and inconvenience of eating these foods by means of the standard knife, fork and spoon eating utensils. Many people prefer to eat certain types of foods this way because it is faster and simpler than cutting these types of foods with a knife and fork into bite size pieces. However, one of the important drawbacks of eating this way is that holding food directly with the hands allows dirt, chemicals, germs, etc. to come into direct contact with food that is promptly ingested. Although washing the hands provides a degree of protection from the risks associated with this unsanitary practice, there nevertheless remains a significant risk of detriment to one's health therefrom. This is because all the germs cannot easily be washed or scrubbed from a person's hands especially the fingertips and underside of the fingernails. Bacteria clings tenaciously via electrostatic forces to a person's skin and thus cannot be easily rubbed off or washed off. In addition, not all types of soap are capable of destroying all the bacteria on a person's skin. Moreover, many people do not take the time and effort to effectively wash their hands thoroughly. Since a person's hands frequently come into contact with a variety of objects and body surfaces, this is consequently a significant way in which people can self-inoculate themselves with germs and thereby contract disease.

Another detriment resulting from this unsanitary practice is that many people use a variety of industrial chemicals i.e., inks, solvents, etc., and household chemicals i.e., cleaning compounds, insecticides, etc., that are known to be harmful if ingested but nevertheless are useful for their commercial or home use and thus remain in common use. Some of the chemicals that people handle become imbedded in the skin of the hands and for this or other reasons remains on the skin even after washing, albeit perhaps in just trace amounts. Consequently, these chemicals can be transferred to the food and promptly ingested. This occurs to a much greater degree when eating certain foods that commonly contain copious amounts of oil such as deep-fried chicken, etc. because the oil acts to emulsify these chemicals (as well as dirt and other types of contaminants) and thereby remove them from the hands and transfer them to the food. For this as well as other reasons, many people choose to use a napkin, paper towel, wax paper, etc. to cover the food before holding and eating it. However, the oil from the food often soaks through such covering wraps contaminating the user's fingers and negating the effectiveness of this more sanitary practice. Moreover, this practice typically requires the use of many such covering wraps for a meal resulting in a messy looking dining area and a lot of trash to clean up afterward.

In an effort to address this problem, many types of utensils have been designed to handle items of food. Some of these utensils include a pair of pivotally or hingedly connected arms, the opposing ends of which may be brought together into contact with each other and thus used to grip a piece of food therebetween. The opposing ends of many designs of such utensils include teeth to provide a means for gripping the food. An example of such a utensil is disclosed in U.S. Pat. No. 4,728,139 to Oretti. The Oretti utensil is a pair of tongs which have substantially similar length arms joined at their inner ends by an integral junction portion. The junction portion bears against a fulcrum block at the free end portions of the respective arms in order to relieve or eliminate bending stress on the junction. However, a primary disadvantage of the Oretti design is its complexity which makes it more expensive to manufacture.

Other such utensils have been specifically designed to hold certain types of foods. An example of such a utensil is disclosed in U.S. Pat. No. 4,802,704 to Burns. The Burns utensil consists of two oppositely disposed members pivotally joined at one end to simulate retractable jaws which are spring biased so that they are normally in an open position. The unjoined ends of the members are provided with opposing teeth for grasping a spare rib therebetween. One of the members is also provided with a ramp for guiding the spare rib to the jaws. Although the Burns holder can grasp the spare rib at only one location thereof, its general dimensioning and wall structures act to retain the spare rib therein. However, a primary disadvantage of such holders is that they are suitable only for certain types of foods. In addition, as with the Oretti utensil, the Burns holder is somewhat complex in construction and thus not inexpensive to manufacture. Moreover, the hinge construction provides an area in which food particles (and therefore bacteria) may collect, hampering its rotational movement and making it unsuitable for reuse (although it is not inexpensive to purchase) because it is difficult to clean.

Other utensils are designed to be of one-piece construction. U.S. Pat. No. 3,934,915 to Humpa discloses a one-piece pair of tongs composed of plastic and provided with rows of teeth at the upper and lower end portions thereof. However, a primary disadvantage with the Humpa tongs is that the rows of teeth are flat and thus not shaped to conform to chicken drumstick bones or other types of food which have curved portions. Thus, the flat rows of teeth are able to grip the curved portion of the food i.e., the bone, at only one location resulting in a somewhat less than secure and rigid grasping thereof.

Some tong types of utensils have curved portions providing more secure gripping. Two examples of such utensils are disclosed in U.S. Pat. Nos. 4,577,900 and 4,877,280 to Chasen and Milano. The Milano tongs have convex gripping end surfaces and are used for picking up paper. The Chasen tongs are used for eating and have outer lateral knurled portions which are longitudinally curved to conform to the shape of the food or other thing to be gripped. However, the rows of teeth positioned inside the lateral portions are not curved. Moreover, only the front of the outer longitudinal portions is knurled, thereby limiting the full grasping action of the tongs to foods gripped from the lateral sides. The front of the outer longitudinal portions is also straight rather than curved further limiting its full utility to grasping food from the lateral sides. In addition, the Chasen design utilizes two tong members joined together by a pin and also having spring loaded outer end portions. The design is thus not only complex but has areas i.e., the connections, which collect food and germs, and which are difficult to properly clean. In addition, these connections can become clogged with food particles thereby impeding rotational movement of the tongs and compromising its utility.

Despite many earlier designs, there is a need for an eating utensil which is simple in construction having no connection points thereby rendering the utensil inexpensive to manufacture and relatively trouble-free in use as well as providing no cleaning requirements or difficulties.

SUMMARY OF THE INVENTION

The present disclosure provides an eating utensil which is simple in construction having no connection points thereby rendering the utensil inexpensive to manufacture and relatively trouble-free in use as well as providing no cleaning requirements or difficulties. The eating utensil provides enhanced versatility by allowing food to be gripped from the front or lateral sides of the utensil. The eating utensil provides firm and secure gripping of the food thereby enabling enhanced dexterous control of the food and thereby facilitating the job of eating the food.

An eating utensil for gripping food such as chicken drumsticks is disclosed. The utensil has a tube which is shaped and dimensioned to accommodate the end of the chicken drumstick. The utensil is made of a springy material such as silicone so that finger pressure may bend the material to grip the chicken. The opening is sized to accommodate the shape of the food and provide more secure gripping thereof. A material such as a soft non-slip grip silicone may be used. A plastic ridge surrounds the top to act as a plastic "grease dam" and keep drips from the hand. A small hole at the bottom allows for easy cleaning and drying.

Also disclosed is a method to hold a chicken drumstick in a way that will keep hands from getting dirty, will keep it from slipping, is safe for children to use (it will not allow them to be burnt, or pinched, etc.), and is also not a burden on caretakers to clean.

In a preferred embodiment, the material used to form the utensil is made from highly heat resistant silicon. Depending on the functional characteristics desired, the wall thickness may vary between 0.015 inches and 0.090 inches. In other embodiments the device may be made from flexible plastic. It is preferred that the material be dishwasher safe. In a preferred embodiment the material used to for the utensil is made from BPA free and PVC free materials.

In some embodiments the device invention may be further comprised of a "grease dam" at the top of the tube which can further keep any drips off of fingers. In other embodiments the device may be further comprised of bottom most portion of the tube so that drippings may not come out of the bottom of the tube. This could lead to tradeoffs with drying and cleaning. In other embodiments the device may be further comprised of one or more holes at the top of the wall. In embodiments having tabs, the holes may be disposed therein. The holes may be used for the placement of retail tags.

It is a principal object of the present invention to provide an eating utensil which is simple in construction so that it is inexpensive to manufacture as well as easy and relatively trouble-free to use.

It is another object of the present invention to provide an eating utensil which is shaped to accommodate a chicken drumstick.

It is also an object of the present invention to provide an eating utensil which is able to firmly and securely grip food.

It is also an object of the present invention to provide an eating utensil which allows effective gripping of food while surrounding the base.

It is an object of the present invention to provide an eating utensil which is shaped and contoured to conform to pressure applied by the user, including children.

It is an object of the present invention to provide an eating utensil having a cylinder which are in a circular position when the utensil is not being gripped by a user.

The eating utensil of the present invention is specifically designed to grip poultry parts such as chicken drumsticks, spareribs and other types of food having bony parts. These types of foods are commonly eaten without the aid of utensils. However, since such foods typically contain copious amounts of oil or sauce, they have a slick surface which makes it more difficult for the diner to firmly hold them with his bare hand. But the food gripper utensil of the present-invention provides a convenient and easy to use means for eating such foods. The food gripper utensil has minimal moving parts and is simple in construction making it inexpensive to manufacture and purchase. This makes it particularly attractive as an easy to clean utensil and well suited for use by children and the maintenance of many sizes and duplicate copies per household similar to corn on the cob handles.

In an exemplary embodiment the utensil is comprised of a one-piece flexible structure. This structure forms a hollowed-out space, or cavity, within the structure into which food items may be placed. The wall thickness is about 0.057 inches. In a preferred embodiment the device is dimensioned to provide a single serving, e.g., the eating of one drumstick.

The food gripper utensil includes a lip on the top which acts as a plastic "grease dam" to keep any additional drips off of the hands. It is small enough also to not get in the way of eating the meat or food near the bottom. The tube is able to be pressed against the food so that the diner can thus bite into the drumstick without worry or concern that the drumstick will slip out of the utensil or move around within the utensil thereby making the eating experience more difficult. There is an option of including a closed bottom of the gripper so that any oils or juices do not leak out of the bottom. This includes a potential tradeoff for cleaning and drying the utensil.

Pieces of food that are typically eaten without conventional utensils such as chicken parts and ribs have curved bone surfaces. Consequently, in order to conform to the shape and contour of these food pieces, the circumference of the tube needs to be large enough that the food can easily be slipped into the opening, but not so large that too much pressure needs to be applied to grab the food. The increased number of points of contact act to generally minimize movement between the food and the utensil by increasing the frictional forces therebetween. Additionally, too large of a circumference will negatively impact the experience of children or others with small hands using the tool. Eating the drumstick (or other suitable type of food) thus becomes relatively easy especially in comparison with bare hand eating of such foods which are typically slippery due to the oil or sauces. The food gripper utensil thus provides dexterity to the task of eating chicken drumsticks and other suitable foods.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION

Figure 1:
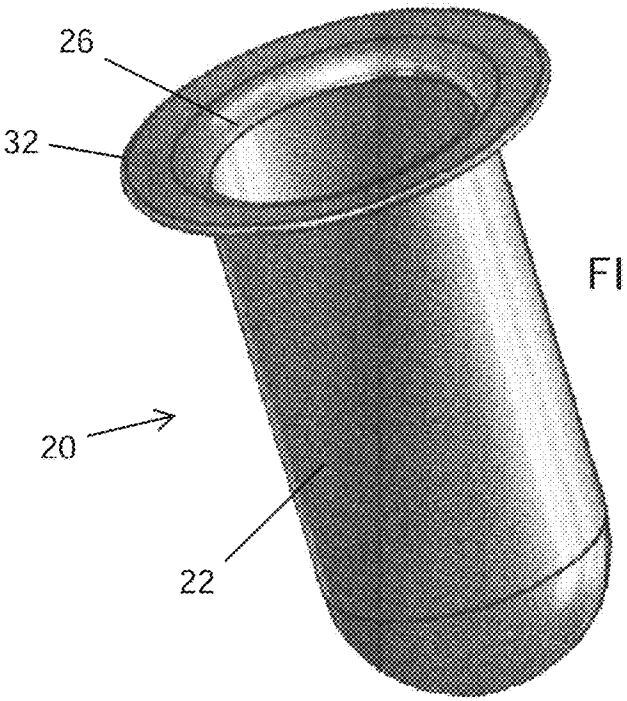
FIG. 1 is a perspective view of a first embodiment of a food gripper utensil of the present invention for gripping a chicken drumstick and having a grease dam.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

Furthermore, unless otherwise stated, any specific dimensions mentioned in this description are merely representative of an exemplary implementation of a device embodying aspects of the invention and are not intended to be limiting.

Referring to the drawings, the present invention is an eating utensil for gripping food. The food gripper utensil is adapted to be positioned between a user's fingers (or finger) and thumbs. The utensil is preferably approximately one and seven-eighths inches in length, seven-eighths inches in height at the front, one and one-eighth inches in height at the rear, three-quarters inches in width at the front and one and one-quarter inches in width at the rear to generally conform to the size and shape of the forefinger and thumb (more specifically, the front portions thereof) of an average size user.

The utensil preferably includes a tube with an enclosed bottom and ridged opening. The tube is preferably a piece (or sheet) of plastic or other suitable flexible material which allows bending thereof so that it can open and close around the food. The tube is also preferably composed of a material which has memory so that after the is closed it tends to revert back to its extended shape and position. Thus, the tube has a springy feel when closed manually and springs back to its open (or extended) position upon release of the manual pressure exerted thereon. This allows the tube to be in an open position normally and when the utensil is grasped and ready to be positioned around the end of a chicken drumstick (or other such suitable piece of food). The springy characteristic of the tube is not of such a high degree that it presents inordinate resistance to closing the tube manually. In such an open default position, the utensil is sufficiently open to allow it to be easily positioned around a piece of food.

Figure 2C:
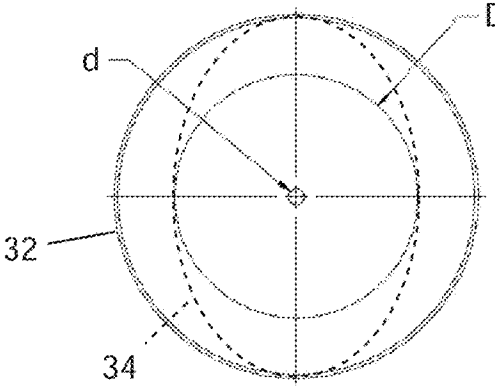
FIGS. 2A-2C are orthogonal and sectional views of the first embodiment of the food gripper utensil, with FIG. 2B showing the utensil with a chicken drumstick inserted therein.
Figure 2B:
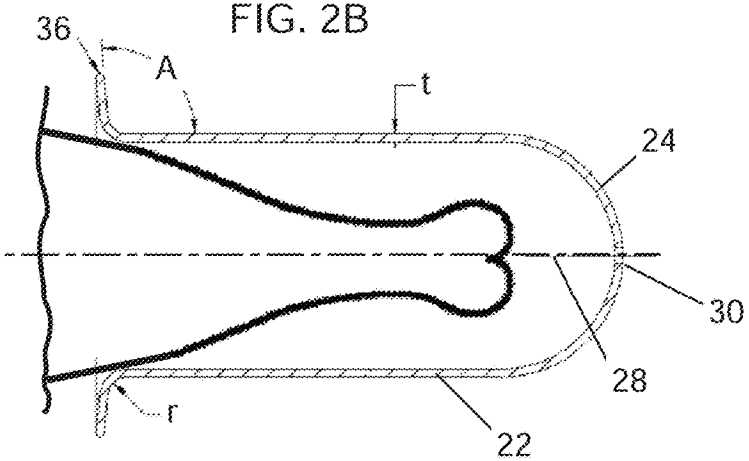
Figure 2A:
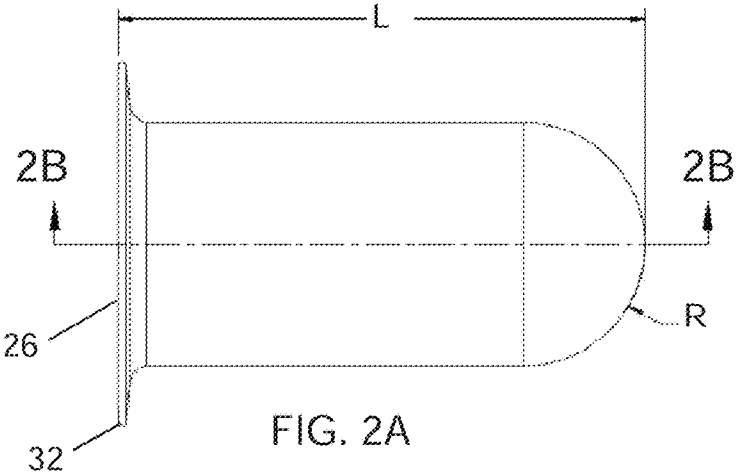

FIG. 1 is a perspective view of a first embodiment of a food gripper utensil 20 of the present invention for gripping a chicken drumstick and having a grease dam, while FIGS. 2A-2C are orthogonal and sectional views of the first embodiment of the food gripper utensil.

The food gripper utensil 20 comprises a generally tubular body 22 with a substantially closed end 24 opposite an open end 26 along an axis 28. The closed end 24 may have a hemispherical or otherwise rounded shape and may have a small hole 30 disposed at a center thereof. The open end 26 flares outward into an outward flange 32, much like the horn of a trumpet. The outward flange 32 may be entirely circular, or less than circular such as the oval shape indicated at 34 in dashed line in FIG. 2C.

FIG. 2B shows the utensil 20 with a chicken drumstick inserted therein. Due to the highly flexible nature of the material with which the utensil 20 is made (e.g., silicone), a user can easily squeeze the tubular body 22 to grasp the bone end of the drumstick. Various internal ribs or other such features may be provided on the inner surface of the tubular body 22 to improve the grip, as will be shown below. It should be understood that any features disclosed herein for one embodiment, such as internal ribs or the flange 32, may be incorporated or otherwise combined into any other embodiment, unless physically mutually exclusive.

The hole 30 in the otherwise closed end 24 allows water to drain out to facilitate cleaning of the utensil 20. The outward flange 32 provides a greased dam of sorts to help prevent grease or other liquids from the food being held to run down the outside of the tubular body 22.

Various dimensional indicators are provided which are exemplary only. For instance, an outer rim 36 of the flange 32 may be rounded, and the flange may make an angle A with the longitudinal axis 28 of about 95°, so as to be slightly tilted away from the closed end 24. The flange 32 also preferably makes a flare radius r of about 0.25 inches. A thickness t of the walls of the utensil 20 is desirably between about 0.10-0.20 inches, preferably about 0.10 inches. The closed end 24 may have a hemispherical shape with a radius R of about 1.5 inches. A total length L of the utensil 20 is desirably between about 4-8 inches, more particularly between about 5-7 inches, and in a preferred embodiment is 6.5 inches. A diameter D of utensil 20 is desirably between about 2-4 inches, and more particularly is about 3 inches. Finally, the small hole 30 may have a diameter d of about 0.2 inches. These dimensions are exemplary, and where features are common are representative of the dimensions for the other disclosed embodiments.

Figure 3:
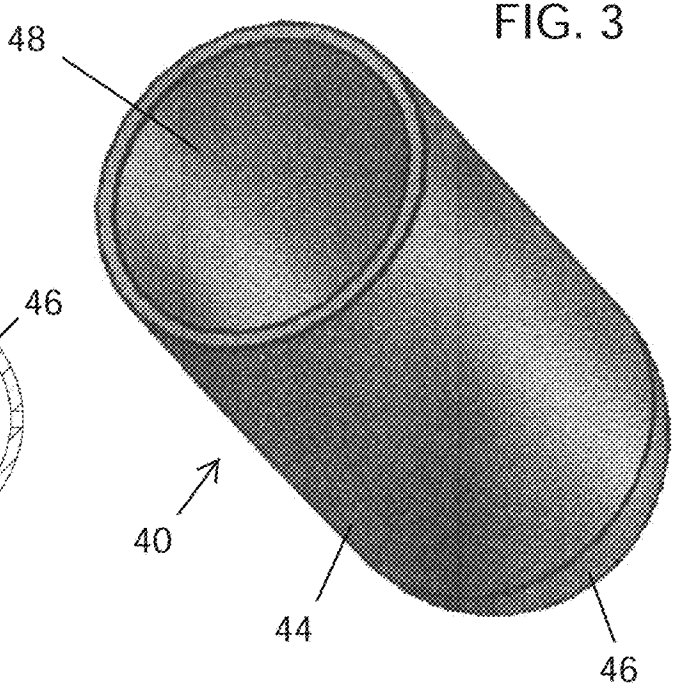
FIG. 3 is a perspective view of a second embodiment of a food gripper utensil of the present invention for gripping a chicken drumstick and having horizontal internal ribs.

FIG. 3 is a perspective view of a second embodiment of a food gripper utensil 40 of the present invention for gripping a chicken drumstick having horizontal internal ribs 42, while FIGS. 4A-4D are orthogonal and sectional views of the second embodiment of the food gripper utensil. The ribs 42 extend radially inward from an outer tubular body 44, comprise walls having a thin axial dimension, are made homogeneously of the same material, and are located closer to a closed end 46 than an open end 48. Though the open end 48 is shown as a circular end of the tubular body 44, a flared flange as in the first embodiment may also be used, as mentioned.

Figure 4D:
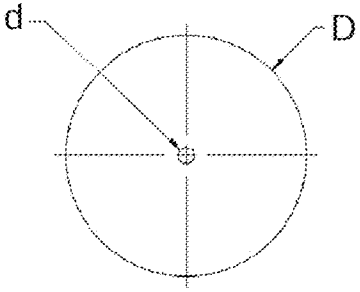
FIGS. 4A-4D are orthogonal and sectional views of the second embodiment of the food gripper utensil.
Figure 4B:
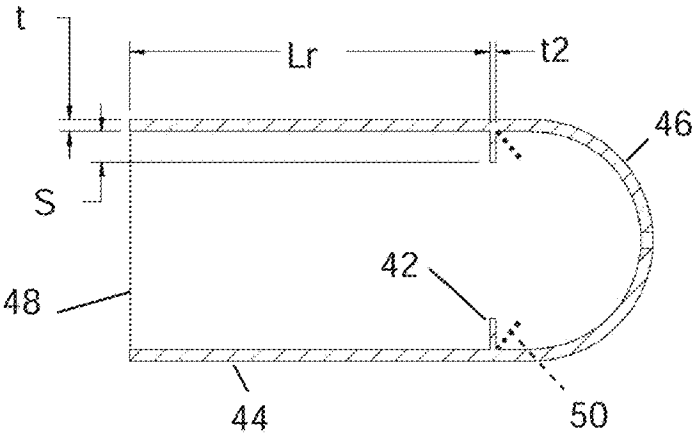
Figure 4A:
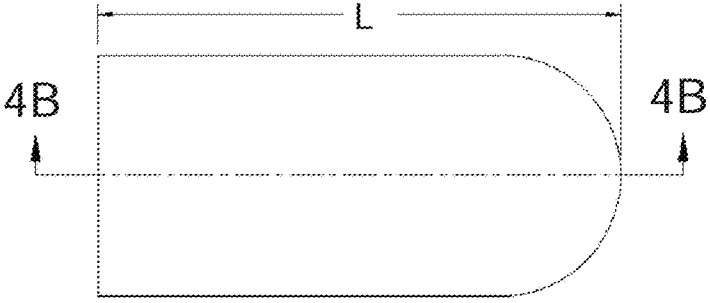
Figure 4C:
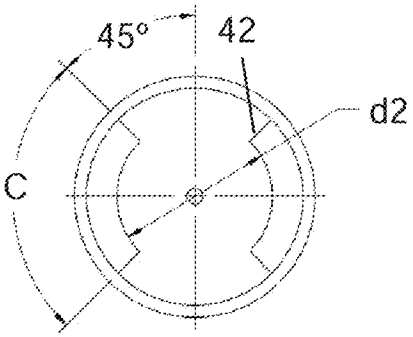

As seen in FIG. 4C, there are two of the ribs 42 diametrically opposed to each other and spanning a chordal angle C which is preferably between about 60-120°, such as 90°. A thickness t2 of each rib 42 may be about half the thickness t of the walls of the utensil (which is about 0.15 inches), or about 0.08 inches. The ribs 42 may extend inward a distance S so as to narrow an internal diameter d2 to be around 2 inches, preferably 1.9 inches. The ribs 42 are desirably located a distance Lr from the open end of about ⅔ of the way into the utensil 40. Thus, if the total length L is 6.5 inches, the distance Lr is between about 4-5 inches, more preferably about 4.5 inches. Though the ribs 42 are shown perpendicular to the wall of the tubular body 44, they may also be angled toward the closed end 46, as shown at 50. Finally, there may be more than two ribs 42, such as three or four, and there may be a series of axially-spaced ribs 42 rather than just two diametrically opposed ribs.

Figure 5:
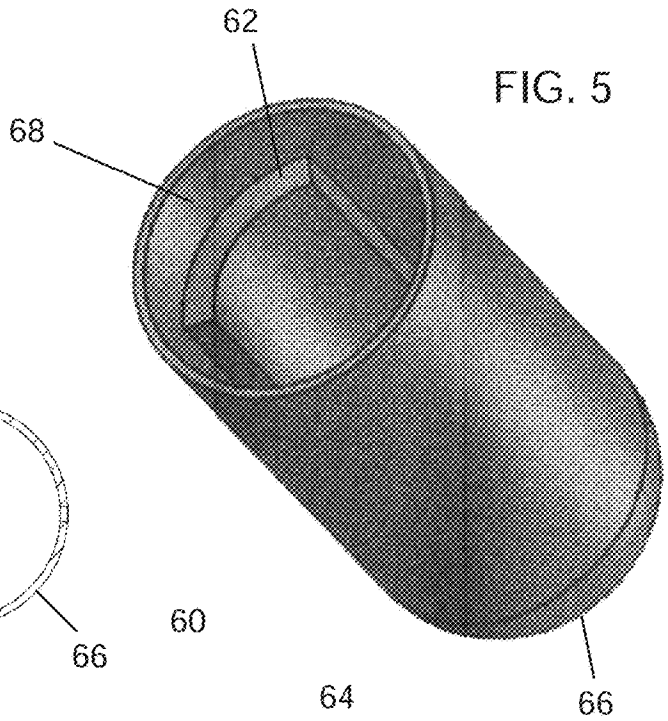
FIG. 5 is a perspective view of a third embodiment of a food gripper utensil of the present invention for gripping a chicken drumstick and having axial internal ribs.

FIG. 5 is a perspective view of a third embodiment of a food gripper utensil 60 of the present invention for gripping a chicken drumstick and having axial internal ribs 62, while FIGS. 6A-6D are orthogonal and sectional views of the third embodiment of the food gripper utensil. The ribs 62 extend radially inward from an outer tubular body 64, are made homogeneously of the same material, and are generally centered between a closed end 66 and an open end 68. Though the open end 68 is shown as a circular end of the tubular body 64, a flared flange as in the first embodiment may also be used, as mentioned.

Figure 6B:
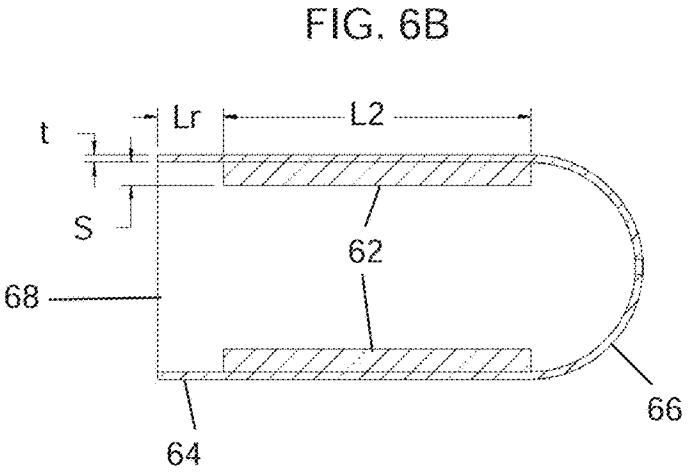
FIGS. 6A-6D are orthogonal and sectional views of the third embodiment of the food gripper utensil.
Figure 6A:
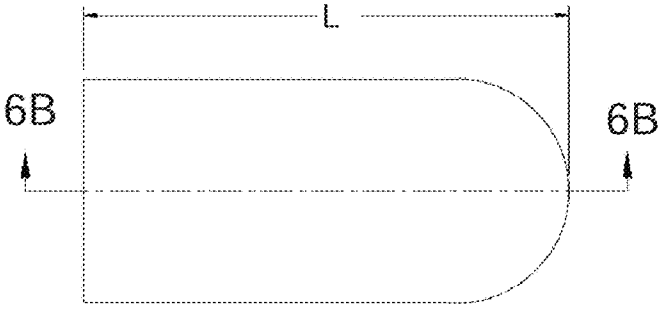
Figure 6D:
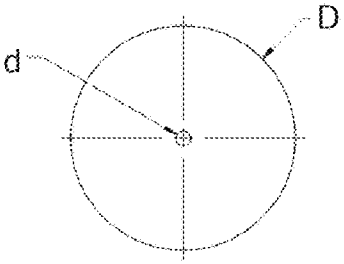
Figure 6C:
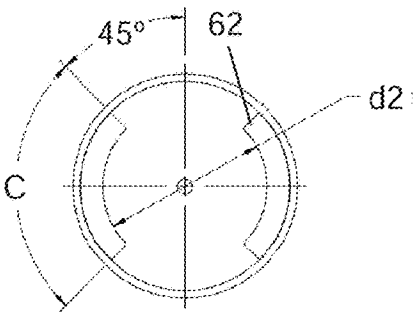

As seen in FIG. 6C, there are two of the ribs 62 diametrically opposed to each other and spanning a chordal angle C which is preferably between about 60-120°, such as 90°. An axial length L2 of each rib 62 may extend along a majority of the total length L, such that if the total length L is between 4-5 inches, or about 4.1 inches. Thus, the ribs 62 do not resemble the thin axial profile of the ribs 42 described above, but instead more resemble thick inner extensions of the walls of the tubular body 64. The ribs 62 may commence a short distance Lr in from the open end 68, such as about 1.0 inches or less. The ribs 62 may extend inward a distance S so as to narrow an internal diameter d2 to be around 2 inches, preferably 2.2 inches. In this embodiment, the wall thickness t is less than before, preferably around 0.10 inches. Finally, there may be more than two ribs 62, such as three or four, evenly distributed around the inner circumference.

The utensil is preferably unitary such that all the components thereof are integral with each other. The utensil is also preferably composed of a suitable plastic material. These features enable the utensil to be inexpensive to manufacture and purchase.

Accordingly, there has been provided, in accordance with the invention, a utensil for gripping and eating food that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

Another aspect of the device is that the utensil may be manufactured economically. Further, the utensil may be made from readily available materials.

Additionally, the present application contemplates disposable chicken holders that one would use for an event or party to help guests keep their hands clean. They would be ridged like cupcake pan liners in a square shape and made of a paper that grease could not get through like a wax paper, parchment paper, or cardboard, etc. The utensil may be enlarged to have larger, similar design that could go on end of a rib.

Key features of the silicone food utensil include:

Keeps hands clean so you can move between fork and drumstick

Kid-safe—no more "icky fingers"

Dishwasher safe

PVC free, BPA free

Different colors for kids to be excited about

Non-slip

Protects hands from heat

Small hole at bottom for easy cleaning and drying

Grease dam at top to further protect hands (optional)

Alternatives to add to the silicone food utensil include internal gripping mechanisms, vertical ridges, a bump, horizontal ridges, and/or a bump pattern on an inside wall.

CLOSING COMMENTS

Throughout this description, the embodiments and examples shown should be considered as exemplars, rather than limitations on the apparatus and procedures disclosed or claimed. Although many of the examples presented herein involve specific combinations of elements, it should be understood that those elements may be combined in other ways to accomplish the same objectives. Elements and features discussed only in connection with one embodiment are not intended to be excluded from a similar role in other embodiments.

It is claimed:

1. A food holder, comprising:

flexible polymer walls defining a tubular body and an open end opposite a closed end along a longitudinal axis, the tube tubular body having a flared flange on the open end that extends outward from the tubular body, a total length L of the holder being between 4-8 inches, and a diameter D of the tubular body being between about 2-4 inches, and a wall thickness being between about 0.10-0.20 inches such that a user may squeeze the walls of the holder around a food item to hold without touching the food item, and further including a plurality of inwardly-directed ribs connected to the tubular body and made homogeneously of the same material, wherein the ribs comprise walls having a thin axial dimension that span a chordal angle C of at least 60°.

2. The food holder of claim 1, further comprising a small hole centered in the closed end to permit water drainage when cleaning.

3. The food holder of claim 2, wherein the closed end has a hemispherical shape.

4. The food holder of claim 1, wherein there are just two of the ribs diametrically opposed to each other.

5. The food holder of claim 1, wherein the ribs comprise thickened portions of the tubular body that extend an axial length L2 of a majority of the total length L of the holder.

6. The food holder of claim 5, wherein the axial length L2 is between 4-5 inches.

7. The food holder of claim 1, wherein the total length L of the holder is about 6.5 inches, and the diameter D of the tubular body is about 3 inches.

8. The food holder of claim 7, wherein the closed end has a hemispherical shape.

9. A food holder, comprising:

flexible polymer walls defining a tubular body and an open end opposite a closed end along a longitudinal axis, a total length of the holder being between 4-8 inches, and a diameter of the tubular body being between about 2-4 inches, and a wall thickness being between about 0.10-0.20 inches such that a user may squeeze the walls of the holder around a food item to hold without touching the food item, and further comprising a plurality of inwardly-directed ribs connected to the tubular body and made homogeneously of the same material, wherein the ribs comprise walls having a thin axial dimension that span a chordal angle C of at least 60°, and there are just two of the ribs diametrically opposed to each other.

10. The food holder of claim 9, further comprising a small hole centered in the closed end to permit water drainage when cleaning.

11. The food holder of claim 9, wherein the closed end has a hemispherical shape.

12. The food holder of claim 9, wherein the total length L of the holder is about 6.5 inches, and a diameter D of the tubular body is about 3 inches.

13. The food holder of claim 12, wherein the closed end has a hemispherical shape.

14. A food holder, comprising:

flexible polymer walls defining a tubular body and an open end opposite a closed end along a longitudinal axis, a total length of the holder being between 4-8 inches, and a diameter of the tubular body being between about 2-4 inches, and a wall thickness being between about 0.10-0.20 inches such that a user may squeeze the walls of the holder around a food item to hold without touching the food item, and further comprising a plurality of inwardly-directed ribs connected to the tubular body and made homogeneously of the same material, wherein the ribs comprise thickened portions of the tubular body that extend an axial length L2 of a majority of a total length L of the holder, and wherein there are just two of the ribs diametrically opposed to each other.

15. The food holder of claim 14, further comprising a small hole centered in the closed end to permit water drainage when cleaning.

16. The food holder of claim 14, wherein the closed end has a hemispherical shape.

17. The food holder of claim 14, wherein the total length L of the holder is about 6.5 inches, and a diameter D of the tubular body is about 3 inches.

* * * * *